US005855296A

United States Patent [19]

McCann et al.

[11] Patent Number: 5,855,296

[45] Date of Patent: Jan. 5, 1999

[54] COMBINED CARBONATOR AND WATER PRESSURE BOOSTER APPARATUS

[76] Inventors: Gerald P. McCann, 7000 Macapa Dr., Los Angeles, Calif. 90068; Donald Verley, 43015 Lesina Dr., Lake Elizabeth, Calif. 93532

[21] Appl. No.: 746,243

[22] Filed: Nov. 7, 1996

[51] Int. Cl.[6] ..... B67D 5/08

[52] U.S. Cl. ..... 222/61; 222/64; 222/129.2; 222/399; 261/DIG. 7

[58] Field of Search ..... 222/61, 64, 129.1, 222/129.2, 129.3, 129.4, 399; 261/DIG. 7

[56] References Cited

U.S. PATENT DOCUMENTS

| | | | |
|---|---|---|---|
| 3,248,098 | 4/1966 | Cornelius | 261/DIG. 7 |
| 5,411,179 | 5/1995 | Oyler et al. | 222/129.1 |
| 5,538,160 | 7/1996 | Ziesel | 222/61 |
| 5,553,746 | 9/1996 | Jones | 222/129.1 |
| 5,568,882 | 10/1996 | Takacs | 222/64 |
| 5,743,433 | 4/1998 | Hawkins et al. | 222/64 |

FOREIGN PATENT DOCUMENTS

| | | | |
|---|---|---|---|
| 0322729 | 7/1989 | European Pat. Off. | 222/64 |
| 9002702 | 3/1990 | WIPO | 222/129.2 |

*Primary Examiner*—Joseph A. Kaufman
*Attorney, Agent, or Firm*—Lyon & Lyon LLP

[57] ABSTRACT

Disclosed are combined carbonator and water pressure booster apparatuses for holding both carbonated and non-carbonated water at elevated pressures, for the dispensing of carbonated and non-carbonated beverages. Such apparatuses may comprise a tank including a carbonated chamber and a non-carbonated chamber, wherein the two chambers are separated by a diaphragm, bladder, or piston such that the elevated pressure is essentially the same in the two chambers. The apparatus can also comprise a retrofittable add-on tank for use with an existing carbonation unit.

45 Claims, 8 Drawing Sheets

COMBINED CARBONATOR AND WATER PRESSURE BOOSTER APPARATUS

FIELD OF THE INVENTION

The present invention relates to the apparatus used in post-mix beverage dispensers and beverage vending machines; more particularly, the invention relates to a combined carbonator and water pressure booster apparatus for holding both non-carbonated water and carbonated water at elevated pressures, suitable for making both non-carbonated and carbonated drinks in post-mix beverage dispensers or vending machines.

BACKGROUND OF THE INVENTION

The carbonation apparatus, generally referred to as a carbonator, used in conjunction with post-mix carbonated beverage dispensers and/or vending machines, for example, is well-known. FIG. 1 shows a typical prior art carbonator 10. It includes means for supplying both fresh uncarbonated water 16 and carbonating gas, such as $CO_2$, 26 at a regulated pressure to a carbonator tank 12 where the two are mixed to form carbonated water 30. It also includes a conduit for transporting carbonated water 30 from carbonator tank 12 to a post-mix dispensing nozzle 42 of a post-mix tower and dispenser assembly 40, where the carbonated water 30 is mixed in suitable proportions with a quantity of flavor concentrate or syrup 34 from a supply source 32 to produce the composite carbonated drink.

Carbonator 10 also normally includes some type of water pump 18 to supply and replenish uncarbonated water 16 from water supply 14 at an elevated pressure to the carbonator tank 12 which also receives $CO_2$ at elevated pressures from a source 24. Both mechanical and electrical pump configurations have been utilized. The pump 18 (and motor 20, in case of electrical configurations) is generally controlled by means of a level control 28 which senses the amount of carbonated water in the carbonator tank 12. Thus, when a volume of carbonated water 30 is dispensed from the carbonator tank 12, it is replaced by a fresh volume of pressurized non-carbonated water 22.

With the increased popularity of non-carbonated beverages such as tea, orange drink or lemon-lime, there is a greater need for post-mix tower and beverage dispenser assemblies that are equipped to provide both carbonated and non-carbonated beverages. Consequently, the prior art apparatus of FIG. 1 includes a conduit for transporting non-carbonated water 16 (which is generally at a low pressure) from water supply 14 to post-mix non-carbonated beverage dispensing nozzle 49, where non-carbonated water 16 is mixed with a suitable quantity of flavor concentrate or syrup 46 from source 44 to make the desired non-carbonated beverage. The water supply 14 for making the non-carbonated beverage may be the same supply as that utilized in carbonator tank 12 for making carbonated water 30.

A critical aspect of the mixing of the beverage syrup or concentrate (34 or 46) on the one hand, and the carbonated water 30 or non-carbonated water 16 on the other, is that the resulting beverage must be properly proportioned or "ratioed." Depending on the desired end beverage, a precise ratio of water and syrup must be mixed in order that the ultimate taste of the end beverage not be compromised. For example, if too little water or too much syrup are mixed, the end beverage would be sweeter than it ought to be for consumption.

In the case of making a carbonated beverage, because the carbonator tank 12 holds the carbonated water at an elevated and uniform pressure that is nearly independent of any fluctuations in pressure of the water supply 14, the proper ratios in mixing of the carbonated water 30 and the syrup 34 are not significantly compromised by any pressure fluctuations in the water supply 14.

However, if the non-carbonated water 16 is drawn from a typical water source 14 (e.g., tap water), the ratio of non-carbonated water 16 to syrup 46 will be affected by the variations or fluctuations that typically occur in the pressure of such a water supply 14. These pressure fluctuations may have numerous causes, including the use of water in other parts of the premises from which water is drawn, such as water fountains, sinks, showers, toilets, etcetera.

As non-carbonated beverages have garnerned a greater share of the beverage market, there have been efforts to find a solution to the detrimental effects of water pressure fluctuations on the proper ratio of the non-carbonated water 16 and the syrup or concentrate 46. One such effort to minimize the effect of pressure fluctuations in the water supply 14 is depicted in FIG. 2. There, the carbonation and post-mix beverage dispensing system of FIG. 1 is modified to include a separate means for pressurizing the non-carbonated water 16 drawn from source 14 and storing it in a separate water booster tank 50 for making the non-carbonated drink. Tank 50 is usually made of cold-rolled steel and includes an internal plastic liner or special coating to prevent rusting and/or the emission of metallic or other undesirable tastes. Tank 50 incorporates a membrane 51 such as a thick rubber diaphragm or bladder that is locked in place, dividing tank 50 into two sides. Membrane 51 is installed before tank 50 is closed, after which tank 50 is fully welded and sealed. Therefore, if membrane 51 should fail, tank 50 is usually completely discarded since there is no way to effect replacement of membrane 51, other than by cutting tank 50 open and attempting to reweld and reseal it.

One side of tank 50 is generally pre-charged with air to 30 psi at the tank manufacturer's location, however, additional pressure can be added by the customer up to as high as 100 psi. There is generally a tire valve stem 55 on one end of tank 50 to introduce the air pressure, with the opposite end having an inlet for plain water 56 to be admitted and stored. To overcome the pressure on the opposite (air) side of membrane 51, a pump and motor must be utilized. Water 16 from supply 14 may, for example, be pumped to the desired elevated pressure by pump means such as motor 54 and pump 52, and then supplied to tank 50. As water 56 enters the water side of tank 50, membrane 51 expands into the air side of tank 50, raising the pressure therein. When the air pressure is increased to the desired amount, pressure switch 60 will stop motor 54 and pump 52. Non-carbonated water 58 at the desired elevated pressure can then be drawn from tank 50 on demand for mixing with syrup 46 from syrup supply 44. A properly mixed non-carbonated beverage is then available at a designated post-mix dispensing nozzle or faucet 49.

The apparatus of FIG. 2, however, suffers certain deficiencies. Even with the separate water booster tank 50, dispensing non-carbonated drinks can be problematic, because water boosters generally do not exceed 100 psi and normally operate between 60 and 80 psi, while soda water carbonators pressures normally run from 100 to 150 psi. Accordingly, the proportions or rates of syrup flow for carbonated versus non-carbonated drinks need to be set differently. Further, the float controls may need to be sized differently in the non-carbonated faucets than in the carbonated faucets, resulting in increased equipment costs, installation costs, because of the extra parts, special spouts, diffusers and faucets. Moreover, the pressures of the carbonated versus non-carbonated water supplies are independent of each other, introducing further difficulties in trying to maintain the proper mixing ratios of water to syrup.

Further complicating matters, because the majority of drinks sold through most beverage dispensers are carbonated, dispenser faucets are usually equipped with diffusers that create a pressure drop to slow the soda water down as it pours into the cup, thereby preventing foaming. But, because the non-carbonated water pressure is generally already lower than that of the carbonated water, the further reduction in pressure created by these diffusers can cause the non-carbonated water to flow too slowly and/or in insufficient quantity.

A further problem posed by the independent water booster is that some customers like beverages dispensed with reduced carbonation, such as 50%. To achieve this, they may try to blend plain water in a 1:1 ratio with soda water in the faucet. The pressure differential between the carbonated and non-carbonated water supplies, however, may determine the actual ratio of carbonated to non-carbonated water, preventing the desired blending.

Moreover, from the standpoint of cost and space requirements, providing separate means of pressurizing and storing non-carbonated water for preparation of non-carbonated beverages is unsatisfactory. As seen in FIG. 2, the modified post-mix tower and dispenser assembly requires two pressure vessels (or tanks) 12 and 50, possibly two pumps 18 and 52, two motors 20 and 54, a liquid level control 28 set for making carbonated beverages, and a pressure switch 60 set for making non-carbonated beverages. Aside from space requirements (which in the beverage dispenser and vending machine industry is an important concern), this solution entails nearly double the costs of manufacturing, installing and servicing.

In short, the pressurization and pumping equipment required for the non-carbonated water for making non-carbonated beverages in conventional post-mix beverage dispensers and/or vending machines results in a relatively large, bulky, heavy and costly system which is ill-suited for utilization in low-volume, cost-driven, limited space environments, and still may not produce reliable results. Accordingly, there exists a significant need for an apparatus that provides both carbonated and non-carbonated water at a regulated pressure for making well-blended and properly proportioned carbonated and non-carbonated beverages. There is also a need for an apparatus that achieves these objectives in a cost-effective and space-efficient manner by way of a combined carbonator and water booster tank that functions both as a water carbonator and as a pressurized non-carbonated water source. Additionally, there is a need for an apparatus that can be economically retrofitted to existing carbonation units, yet still provide the aforementioned regulated and balanced pressure between the carbonated water and non-carbonated water.

SUMMARY OF THE INVENTION

In one aspect of the invention, a combined carbonator and non-carbonated water pressure booster comprises a tank that is divided into two chambers separated by a membrane such as a diaphragm, bladder, or by a piston, so that the first chamber may contain a body of carbonated water and the second chamber may contain a body of non-carbonated water at substantially the same pressure as the pressure in the first chamber.

In another aspect of the invention, a combined carbonator and non-carbonated water pressure booster uses a single tank, a single pump means, and a single level sensing means for making well-blended, suitably proportioned, carbonated and non-carbonated beverages.

In another aspect of the invention, a combined carbonator and non-carbonated water pressure booster can be made by retrofitting an existing carbonation unit with an internal or external add-on tank wherein the pressure from the carbonation unit is transferred to a non-carbonated water chamber in the add-on tank via a flexible membrane or movable piston located in the add-on tank or between the add-on tank and the existing carbonation unit.

In another aspect of the invention, a combined carbonator and non-carbonated water pressure booster allows well-blended, suitably proportioned, carbonated and non-carbonated beverages to be dispensed from identically equipped faucets, due to balanced pressures.

In another aspect of the invention, a combined carbonator and non-carbonated water pressure booster allows well-blended, suitably proportioned, low-carbonated beverages to be dispensed with a predictable mixture of carbonated and non-carbonated water, due to balanced pressures.

In another aspect of the invention, a combined carbonator and non-carbonated water pressure booster produces well-blended, suitably proportioned, carbonated and non-carbonated beverages in a cost effective and space-efficient manner.

In another aspect of the invention, a combined carbonator and non-carbonated water pressure booster includes a tank housing a relatively soft and flexible membrane such as a bladder or diaphragm, and also includes an opening through which the membrane can be removed and replaced or repaired if necessary.

In another aspect of the invention, a simplified combined carbonator and non-carbonated water pressure booster includes a tank that is preassembled with a heavy-duty membrane such as a diaphragm or bladder, and then welded shut.

In another aspect of the invention, a combined carbonator and non-carbonated water pressure booster includes a water carbonation chamber and a non-carbonated water chamber, and a directional chamber selector valve for selectively directing a water supply into one or the other of these chambers.

In another aspect of the invention, a combined carbonator and non-carbonated water pressure booster includes a water carbonation chamber and a non-carbonated water chamber, and a directional check valve (instead of a selective directional valve) that allows water to move from the non-carbonated chamber to the carbonated chamber, but not vice-versa.

These and other features, aspects, and advantages of the present invention will be better understood with reference to the appended claims, the following description and accompanying drawings.

DESCRIPTION OF THE PREFERRED EMBODIMENTS

Figure 1:
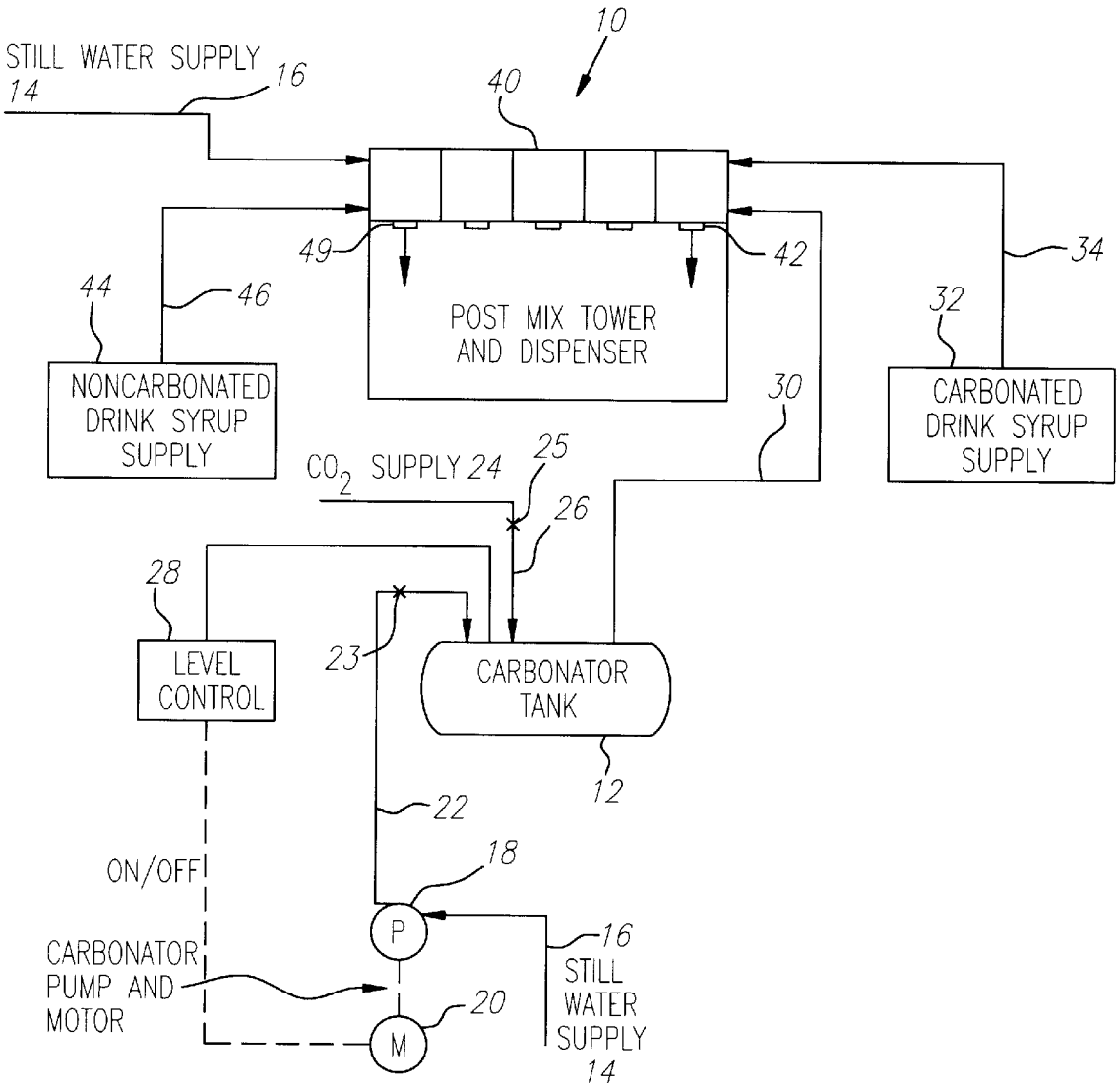
FIG. 1 (PRIOR ART)
FIG. 1 is a partly diagrammatic, partly schematic view of a typical carbonation and post-mix beverage dispensing system of prior art.
Figure 2:
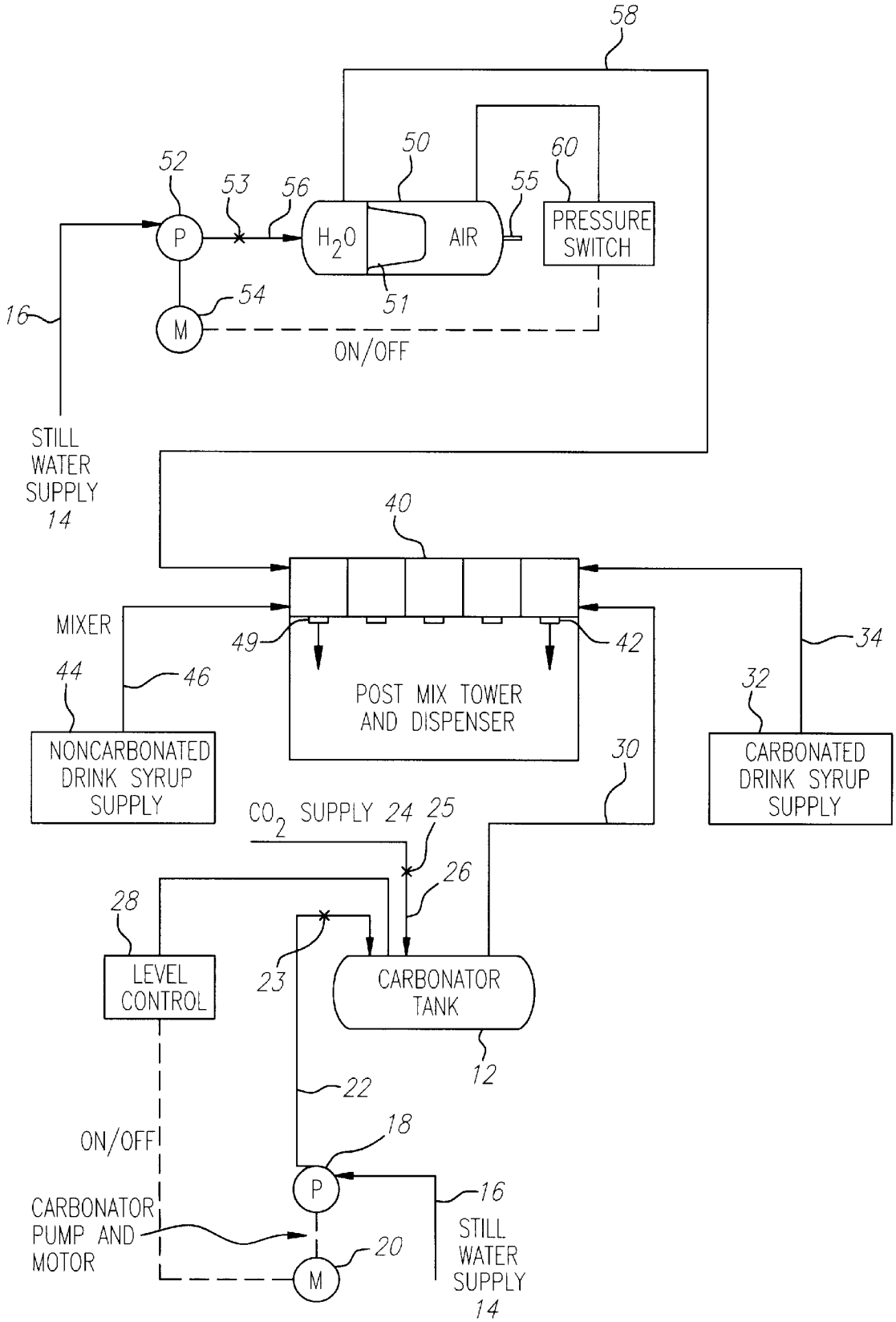
FIG. 2 (PRIOR ART)
FIG. 2 is a partly diagrammatic, partly schematic view of a typical carbonation and post-mix beverage dispensing system of prior art in which non-carbonated water for preparation of non-carbonated beverages is maintained at an elevated pressure in a separate holding tank.
Figure 3:
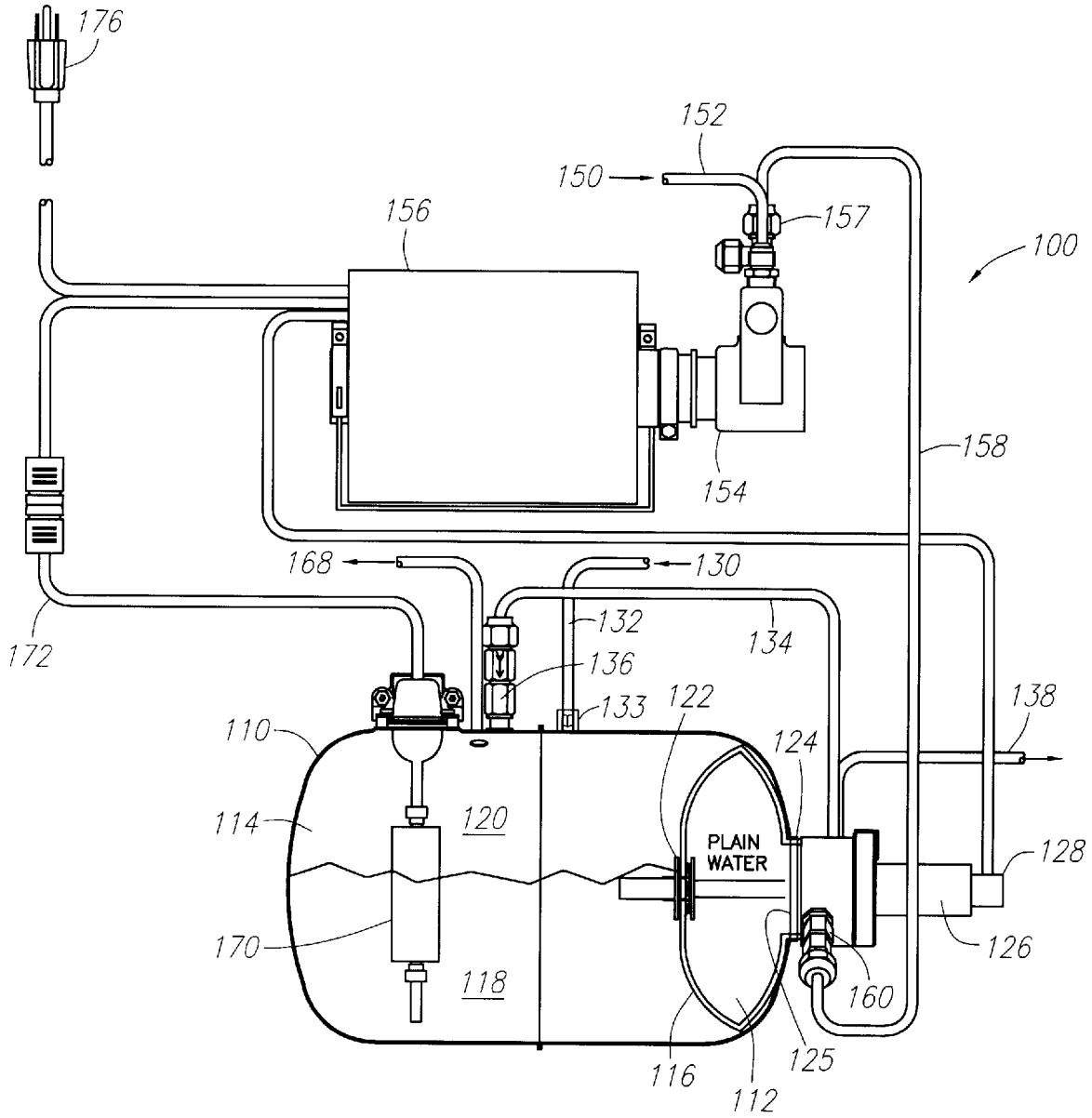
FIG. 3 schematically depicts a side elevational view of a single-tank embodiment of the combined carbonater and non-carbonated water booster tank of the present invention.
Figure 4:
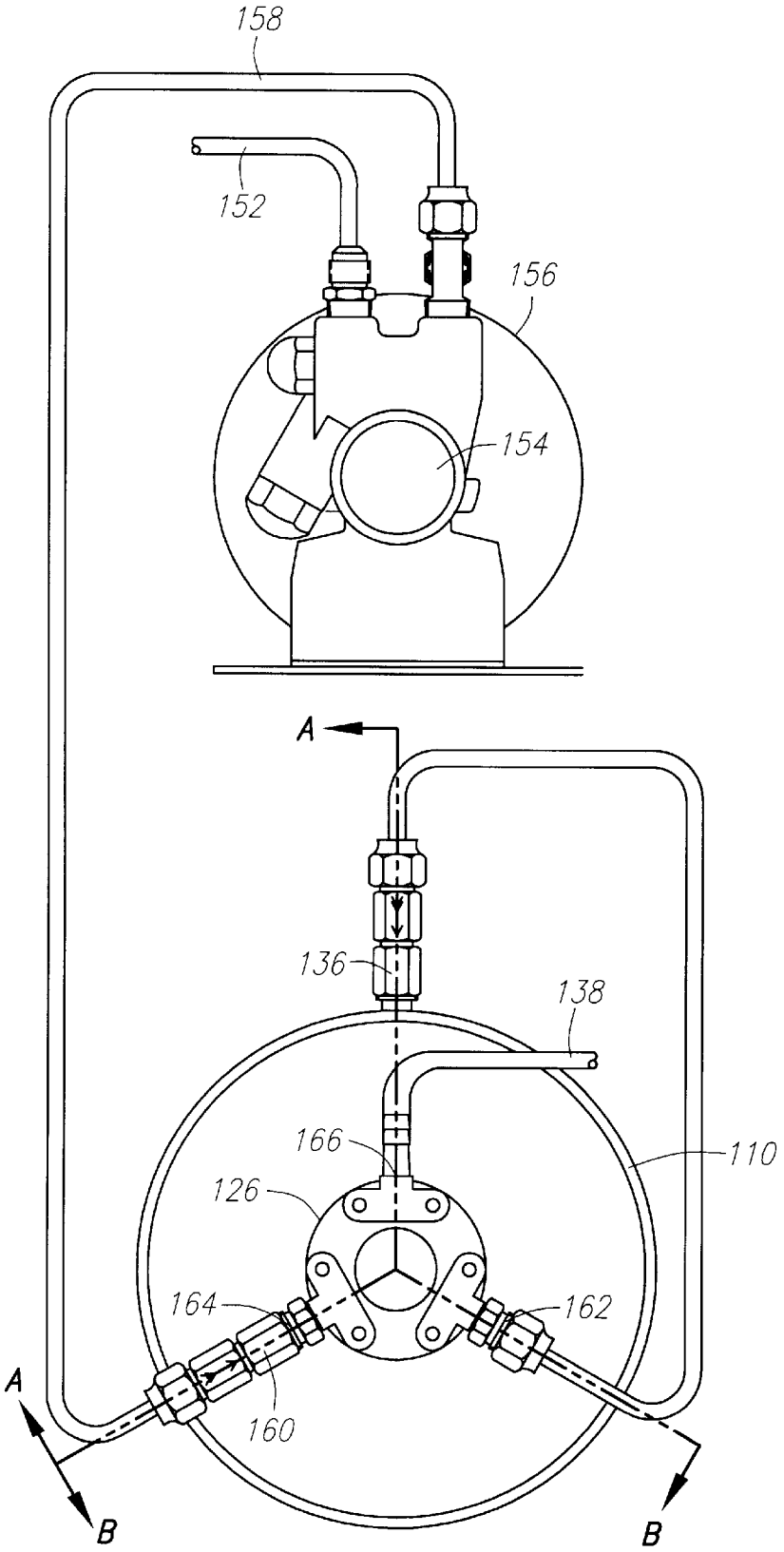
FIG. 4 schematically depicts an end elevational view of the embodiment of FIG. 3.

As shown in FIGS. 3 and 4, an embodiment 100 of the present invention comprises a combined carbonator and pressurized non-carbonated water tank 110 that is internally divided into a carbonated water chamber (or "carbonation chamber") 114 and a non-carbonated water chamber (or "booster chamber") 112 by a flexible membrane 116. Tank 110 may be made of any material that is not reactive with carbonated water, such as stainless steel, and membrane 116 may be a bladder or a diaphragm made of latex or other suitable polymer. In use, chamber 114 contains a body of carbonated water 118 and a "head" of $CO_2$ gas 120, while chamber 112 contains a body of non-carbonated water at a pressure equal to the pressure of the $CO_2$ gas head 120. The carbonated and non-carbonated dispensing nozzles of an associated post-mix beverage dispensing assembly (not shown) are thus supplied by carbonated water outlet line 168 which attaches to an open outlet in the carbonated water chamber 114 side of tank 110, and by non-carbonated water outlet line 138 which attaches to an open outlet on valve assembly 126 communicating with water chamber 112.

Membrane 116 includes a bead 124 that may engage and seal an internal lip (not shown) disposed circumferentially on the inside of tank 110, or, alternately, may circumferentially engage tank opening 125. Membrane 116 may be designed and placed such that, for example, a minimum of 75% of tank 110 is always available for carbonated water chamber 114, and the remaining 25% is available for non-carbonated water chamber 112. The desired division of tank 110 is also contributed to by the relative positioning of lip 141 and restraint 142, which are discussed below.

Chamber selector valve assembly 126 (such as a bidirectional valve) circumferentially engages and tightly seals the open end 125 of tank 110, and, as in the embodiment shown in FIG. 3, may also simultaneously engage and seal bead 124 of membrane 116. A water pump means comprising, for example, a pump 154 driven by a motor 156 pumps water under pressure through double ball valve 157 and water line 158 and into valve assembly 126 where it is directed to either the carbonated water chamber 114 (through water line 134) or the non-carbonated water chamber 112 (through passageway 184, shown in FIG. 5). A high pressure carbonating gas source 130 forces gas such as $CO_2$ into chamber 114 through a gas inlet line 132 and check valve 133. Level sensor 170 (such as the liquid level sensing apparatus disclosed in McCann, U.S. Pat. No. 4,631,375, particularly adapted for use in vessels or tanks containing a fluid of the type utilized in liquid vending machines) activates motor 156 when the level of carbonated water 118 drops to a predetermined lower limit, and turns it off when the level reaches a predetermined upper limit.

As seen in FIGS. 3–6, directional chamber selector valve assembly 126 may be a bi-directional valve with a water inlet 164 which can receive non-carbonated water at elevated pressures through check valve 160 and water line 158, which is fed by pump 154. Chamber selector valve assembly 126 has an annular water outlet 180 that can selectively communicate water at elevated pressures from inlet 164 (from line 158, if pump 154 is pumping) into non-carbonated water chamber 112. Valve assembly 126 also has a water outlet 162 that can selectively communicate water at elevated pressure from inlet 164 (from line 158, if pump 154 is pumping) into carbonated water chamber 114 through line 134 and check valve 136. Finally, valve assembly 126 has a non-carbonated water outlet 166 which is always open, allowing non-carbonated water in chamber 112 to flow through passageway 184 and into water line 138, as it is drawn off at the non-carbonated beverage faucets of the dispenser assembly (not shown).

Valve assembly 126 is configured such that it provides pressurized non-carbonated water from pump 154 to only one or the other of chambers 114 and 112 of tank 110. As in the preferred embodiment shown in FIGS. 5 & 6, this may be accomplished by means of a spool valve 190 axially disposed within the housing 192 of valve assembly 126. (It should be noted that this could equally be achieved by equivalent means such as a solenoid valve). An attachment bushing 122 at the distant end of spool valve 190 firmly engages and anchors to the distant end of membrane 116 (in the embodiment shown, a firm and sealing attachment is made through an orifice provided in the distant end of membrane 116).

Figure 5:
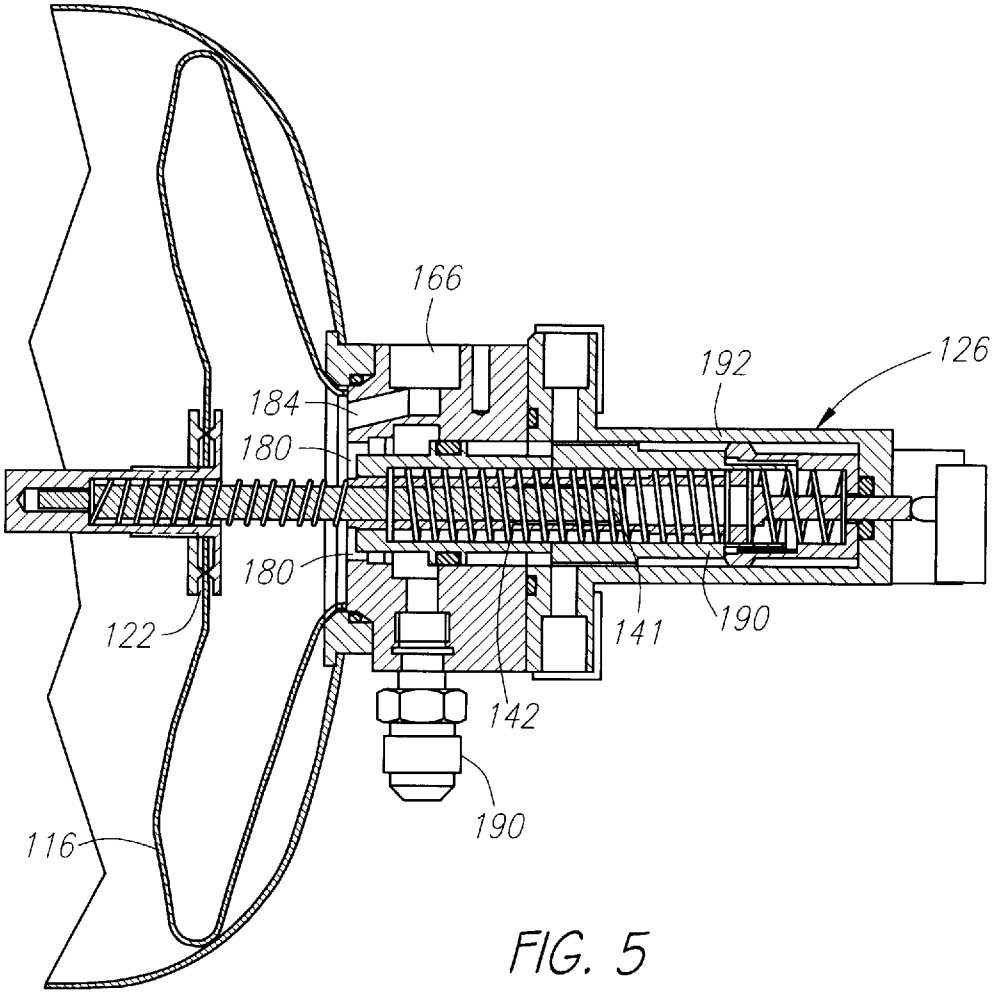
FIG. 5 is a partial side sectional view of the embodiment of FIGS. 3 & 4, taken along the lines A—A (shown in FIG. 4), showing the pressurized non-carbonated water chamber fully compressed, and showing the corresponding conditions in the directional chamber selector valve that is mounted onto the tank.
Figure 6:
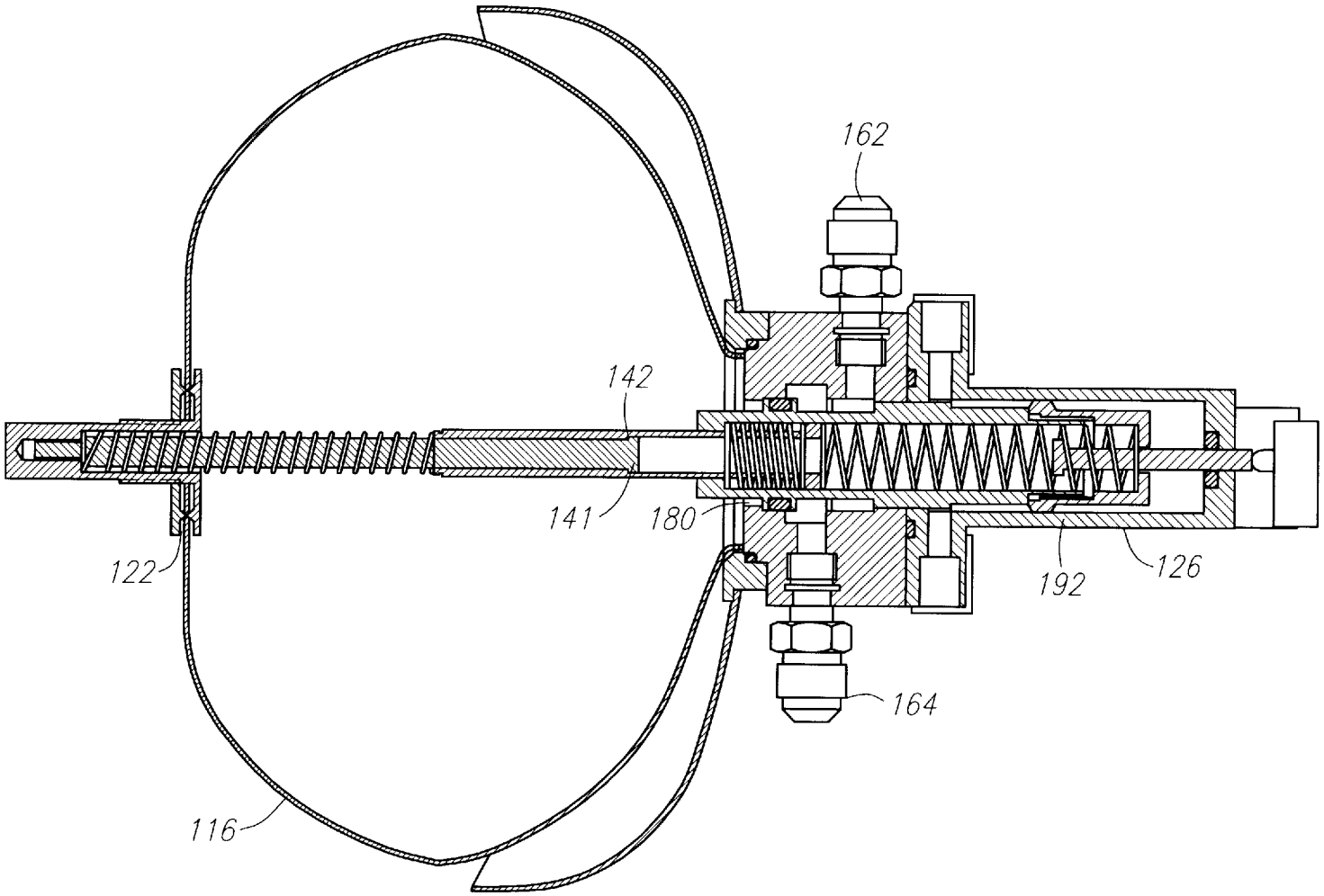
FIG. 6 is a partial side sectional view similar to FIG. 5, but taken along the lines B—B, and showing the non-carbonated water chamber fully expanded, and showing the corresponding conditions of the chamber selector valve.

FIGS. 5 & 6 illustrate how, at any given point, spool valve 190 blocks one or the other of the water outlets 162 or 180. Thus, when membrane 116 is fully expanded, as in FIG. 6, spool valve 190 preferably blocks water outlet 180, preventing communication of water into non-carbonated water chamber 112. On the other hand, as in FIG. 5, when membrane 116 is sufficiently compressed, water outlet 162 is prevented from communicating water into carbonated water chamber 114.

To begin operation, chamber 114 of tank 110 (which is initially empty) is connected via line 132 and check valve 133 to carbonating gas source 130, and also to line 134 via check valve 136. Pump 154 and motor 156 may then be connected to water supply 150 via line 152 and to a power source 176. $CO_2$ is then allowed into carbonated water chamber 114 and attains a desired pressure, typically 100–150 psi. This high pressure causes membrane 116 to become fully compressed, at which point motor 156 activates causing pump 154 to direct water through line 158, check valve 160, and into inlet 164 of valve assembly 126.

Because membrane 116 is fully compressed, spool valve 190 of chamber selector valve assembly 126 obstructs outlet 162, preventing the flow of pressurized water from line 158 into carbonation chamber 114. Instead, spool valve 190 directs the water from line 158 through annular outlet 180 and into non-carbonated chamber 112. Then, as seen in FIG. 6, as chamber 112 expands, spool valve 190 blocks outlet 180, preventing further introduction of water into chamber 112; at the same time, spool valve 190 no longer obstructs outlet 162, allowing pressurized water from line 158 to enter carbonation chamber 114 where it absorbs $CO_2$ from the existing pressurized gas head 120, creating carbonated water 118. Water may flow into carbonation chamber 114 until the level of carbonated water 118 reaches a predetermined maximum point at which level sensor 170 shuts off motor 156 (and thus pump 154) via electrical line 172.

If only carbonated drinks are drawn from the associated beverage dispenser (not shown), non-carbonated chamber 112 is not utilized, and lip 141 remains extended close to or pressed against restraint 142. If non-carbonated drinks are drawn off, water is forced out of non-carbonated water chamber 112 at substantially the same pressure as in carbonated water chamber 114, because the pressure is transmitted by membrane 116. The water level in carbonated water chamber 114 then lowers as membrane 116 contracts and chamber 112 reduces in size. If the volume of chamber 112 is reduced sufficiently, the consequent reduction in the level of carbonated water 118 in chamber 114 will cause liquid level control 170 to signal motor 156 to operate pump 154 and direct water to valve assembly 126. Valve assembly 126, in turn, directs water flow into chamber 112 until the expansion of chamber 112 raises the level of carbonated water 118 in chamber 114 sufficiently, or until lip 141 reaches restraint 142 (after which any further incoming water is directed by valve assembly 126 into carbonated chamber 114 as needed). In either case, liquid level probe 170 turns off motor 156 when the level of carbonated water 118 reaches its maximum design limit. Lip 141 and restraint 142 comprise a supplementary feature that can prevent over-expansion of non-Express carbonated chamber 112.

Conversely, as a separate back-up feature to prevent chamber 112 from contracting too far, chamber selector valve assembly 126 may also incorporate an auxiliary switch 128 that becomes mechanically actuated when non-carbonated water chamber 112 is almost empty, activating motor (irrespective of the state of liquid level probe 170) 156 via line 174, causing pump 154 to direct water to valve assembly 126, through annular outlet 180 and into chamber 112. It should be noted that, depending on the configuration, auxiliary switch 128 may not come into use frequently, because drawing off from non-carbonated chamber 112 will also cause the level in carbonated chamber 114 to drop, and depending on the settings, this may ordinarily be enough to activate pump 154.

Easy replacement of membrane 116 can be allowed for by making tank opening 125 sufficiently large to extract and insert the desired bladder or diaphragm through. In an alternate embodiment, tank 110 could be pre-assembled and welded shut with a heavy duty diaphragm or bladder already in place. The disadvantage of this, however, would be that if membrane 116 should fail, the only way to replace it would involve cutting tank 110 open and then attempting to reweld and reseal it. On the other hand, tank 110 could be manufactured at a reduced cost because it would be less complicated.

Figure 7:
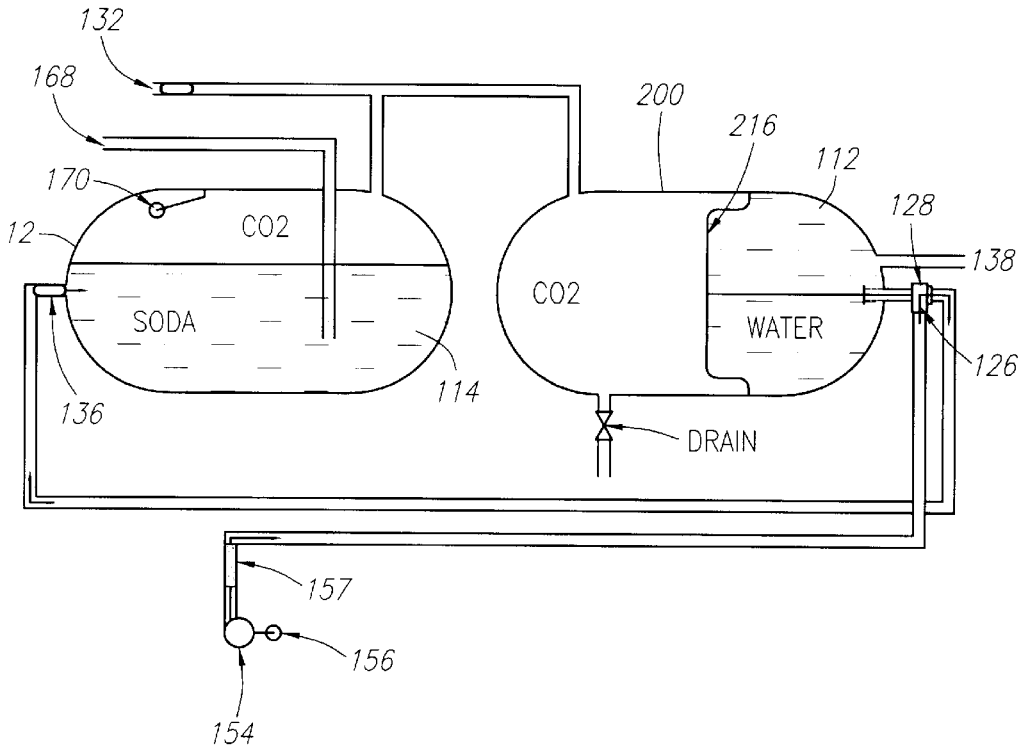
FIG. 7 is a side view of a retrofittable embodiment of the invention including an additional tank that is designed to be connected to an existing carbonation unit.
Figure 8:
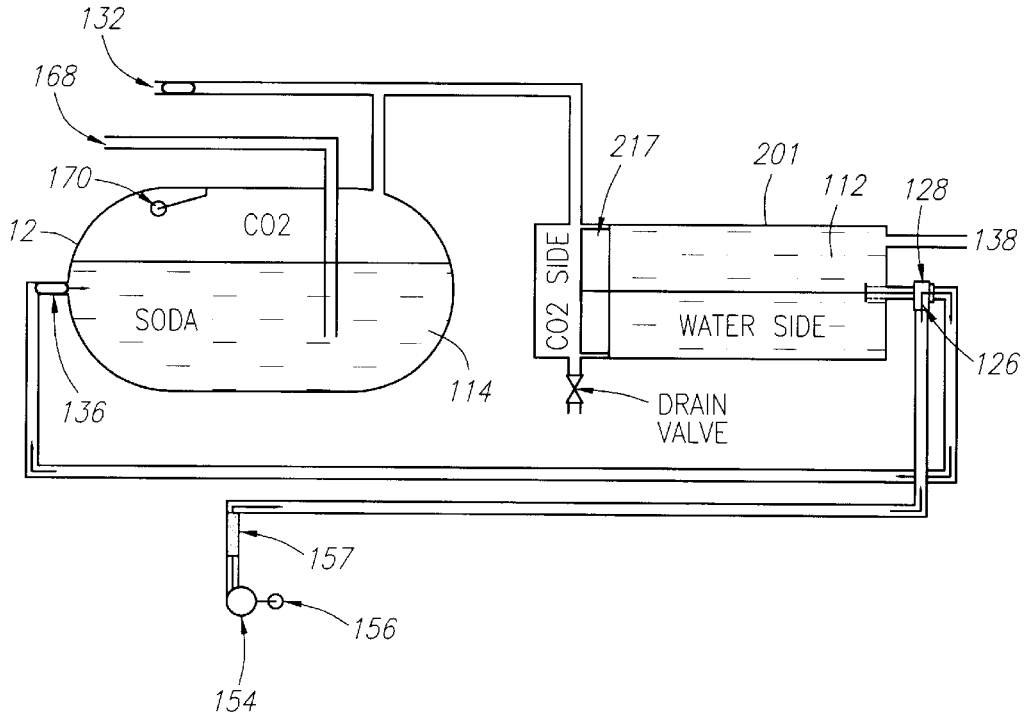
FIG. 8 is a side view of an embodiment similar to that of FIG. 7, but utilizing a piston instead of a membrane.

As shown in FIGS. 7 & 8, an alternative embodiment having some or all of the above discussed features and advantages can be retrofitted to an existing carbonation unit, potentially saving further costs and efforts. In the embodiment shown in FIG. 8, a piston 217 acts in essentially the same fashion as the membrane 116 of the embodiments of FIGS. 3–6 and membrane 216 of FIG. 7, in that it physically moves in response to any pressure differential across its opposing sides (i.e., carbonated and non-carbonated), thereby substantially eliminating that pressure differential. A major difference in the embodiment of FIGS. 7 & 8, however, is that membrane 216 or piston 217 is housed in an add-on tank 200 or add-on cylinder 201 which is directly connected on one side to the interior of an existing carbonation tank 12. Although the depicted arrangement seems best, membrane 216 or piston 217 could be physically separate from add-on tank 200 or cylinder 201, placed for example, inside of a connecting conduit, or so as to project into the interior of existing carbonator tank 12. In any event the principle of pressure equalization is the same.

When connected as shown, tank 12 and tank 200 (or cylinder 201) operate much like the embodiment of FIGS. 3–6, and a chamber selector valve 126 (such as a spool valve or solenoid valve, etc.) may serve to selectively direct the flow of incoming non-carbonated water as appropriate. As shown in FIGS. 7 & 8, the side of tank 200 or cylinder 201 opposing the non-carbonated water chamber 112 can be designed to contain only the carbonating gas, and no carbonated water, and this could be ensured by a low-placed drain valve.

Figure 9:
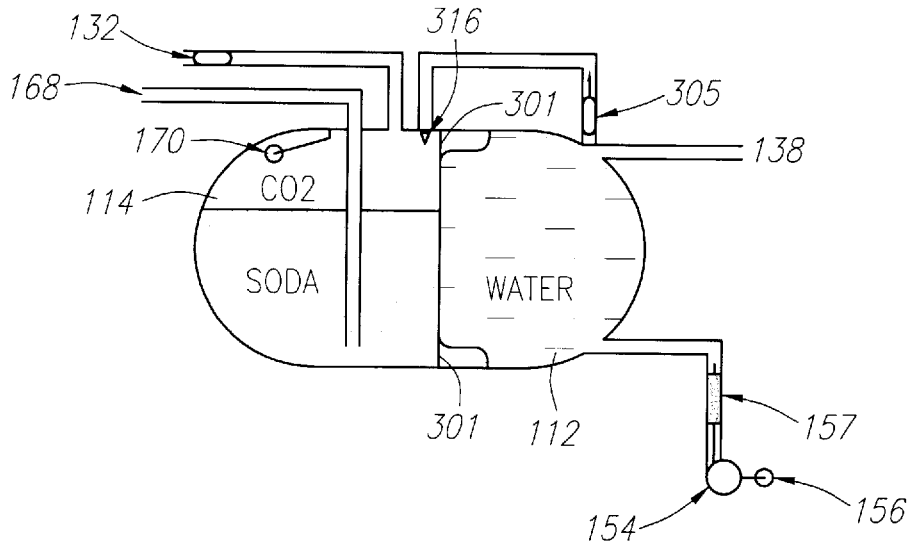
FIG. 9 is a side view of a single tank embodiment of the invention that incorporates a check valve and a membrane restraint to control introduction of fresh water into the carbonation chamber, rather than a directional valve shown in the previous embodiments.
Figure 10:
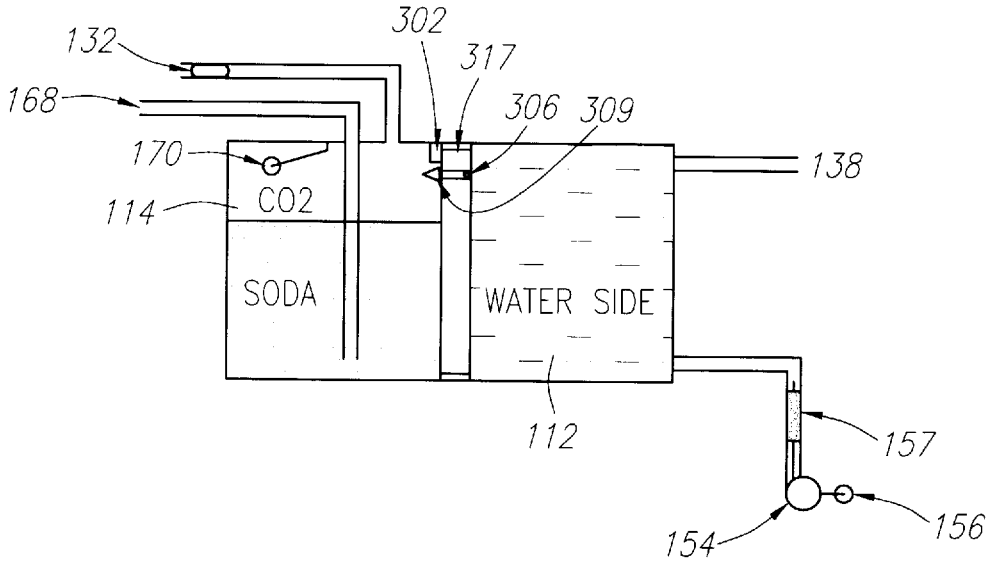
FIG. 10 is a side view of an embodiment similar to that of FIG. 9, but utilizing a piston and a piston stopper rather than a membrane and membrane restraint.

Turning to FIGS. 9 & 10, a third conceptual variation or embodiment of the invention can eliminate chamber selector valve 126 in favor of a one-way check valve 305 or 306 placed between carbonation chamber 114 and non-carbonated water chamber 112. As shown in FIG. 10, check valve 306 may even be placed in the separating member (piston 317) itself. Check valve 305 or 306 of course only flows in the direction going from chamber 112 to chamber 114, and not vice versa. In this embodiment, since chamber selector valve 126 is eliminated, and since water is introduced as necessary into to carbonation chamber 114 directly via check valve 305 or 306, conduit 134 (see FIG. 3) is rendered unnecessary, further simplifying construction.

Placing a physical restraint on the expansion of chamber 112, in the form of a membrane restraint 301 or piston stop 302, ensures that the level of carbonated water 118 in chamber 114 will be always replenished as necessary. It may also be desired to incorporate a pressure drop in line with check valve 305 or 306. If the level of chamber 114 drops too low due to contraction of non-carbonated chamber 112 (upon consumption of non-carbonated water), the subsequent replacement of water in chamber 112 will again reestablish a sufficient level in chamber 114. If carbonated water is drawn off, and water is pumped into chamber 112 until chamber 112 reaches its maximum desired size (which is reflected in the placement of membrane restraint 301 or piston stop 302), but the level of chamber 114 is still too low, further pumping of water, which is incompressible, into chamber 112, then membrane restraint 301 or piston stop 302 will ensure that the pressure in chamber 112 increases sufficiently to overcome check valve 305 or 306 and any pressure drop associated therewith.

On the carbonated side of check valve 305 or 306 there could be placed a spray nozzle 309 such as a venturi nozzle that would increase velocity of the water stream incoming to chamber 114, and a pressure valve that only opens to allow flow into spray nozzle 309 when there is a sufficient pressure differential (which could only occur when membrane 316 reached restraint 301 or piston 317 reached stop 302) between chambers 112 and 114. The triggering pressure differential for the pressure valve would be determined by how much velocity and thus mixing of the water being carbonated in chamber 114 were desired. In this solution, the pressure differential allowed by the pressure valve could cause a transient but undesirable overpressurization of chamber 112 which would momentarily be noticed when non-carbonated water is initially drawn off at outlet 138 (the consequent contraction of chamber 112 causes the physical restraint to no longer be met allowing the pressure in the two chambers to equilibrate). This effect might be eliminated by attaching a small expandable buffer chamber between outlet 138 and the beverage dispenser, the buffer being designed to have a fixed contracted size at pressures below a certain level but to expand when the pressure exceeds that level. When the non-carbonated beverage dispenser is activated, outlet 138 would open to the buffer, which would ordinarily be in its contracted state, and any transient overpressurization of chamber 112 would cause the buffer chamber to momentarily expand, thereby eliminating the overpressurization. The designed amount and rate of expansion for the buffer chamber would be determined in part by the incoming pumped water pressure, the volume of the chambers and lines, and the output rate of the beverage dispenser.

As an alternative to allowing transient pressure differentials between the carbonated and non-carbonated sides of the embodiment of FIGS. 9 & 10, check valve 305 or 306 could be designed to have little or no associated pressure drop, and instead an atomizer or agitator that improves the absorption of carbonating gas from the head in chamber 114 could be placed after check valve 305 or 306.

It is thus seen that the present invention of a combined carbonator and water pressure booster can eliminate the need for much of the apparatus (including a pump, motors, and pressure switch) that is required by prior art devices providing both carbonated water and non-carbonated water to conventional post-mix beverage dispensers. Accordingly, the manufacturing, installation and servicing costs, and the space requirements may be reduced substantially. At the same time, a better controlled non-carbonated water pressure which is balanced with the pressure of the carbonated water can be achieved. In addition to improving the reliability of mixing proportions under all conditions, this is a particularly desirable feature in making lower carbonated drinks which require mixing both plain water and carbonated water with syrup. Further, the invention disclosed herein can also be constructed so as to allow easy replacement of the parts most likely to fail, and it can be made as a unitary apparatus, or as one that attaches to existing equipment with little modification thereto.

It is clear from the foregoing disclosure that while particular forms of the invention have been illustrated and described, various modifications may be made without departing from the spirit and scope of the invention. Accordingly, it is not intended that the invention be limited to the foregoing disclosure except as by the appended claims.

What is claimed is:

1. A combined water carbonator and non-carbonated water pressure booster for use with a carbonating gas source, for supplying both carbonated and non-carbonated water to a beverage dispenser, comprising:

(a) a carbonation chamber in a first tank including an interior and a carbonated water dispensing outlet, said interior connected to the carbonating gas source;

(b) a booster chamber in a second tank including an interior and a non-carbonated water dispensing outlet, said booster chamber connected to said carbonation chamber so as to form an area of interface between said chambers, said area of interface being or including a region that is sufficiently flexible or movable to permit the transmission and equilibration of pressure between said interiors of said chambers, and said area of interface being impermeable in the direction going from said carbonated chamber to said non-carbonated chamber;

(c) a pressurized water source including an output connected so as to feed water to said interior of said booster chamber and to said interior of said carbonation chamber; and, (d) a carbonation chamber water level controller coupled to said pressurized water source, said level controller including a carbonated water level sensor.

2. The apparatus of claim 1, said region of said interface comprising a flexible membrane.

3. The apparatus of claim 1, said region of said interface comprising a movable piston.

4. The apparatus of claim 1, wherein said pressurized water source output is controlled by said water level controller.

5. The apparatus of claim 1, wherein said pressurized water source further comprises a water source and a pump, and said pump is controlled by said water level controller.

6. The apparatus of claim 1, wherein said carbonated water level sensor senses a predetermined low water level condition and said water level controller activates said pressurized water source in response to the sensor's sensing of such low water condition.

7. The apparatus of claim 6, wherein said carbonated water level sensor also senses a predetermined high water level condition and said water level controller deactivates said pressurized water source in response to the sensor's sensing of such high water condition.

8. The apparatus of claim 1, further comprising a booster chamber volume controller coupled to said pressurized water source.

9. The apparatus of claim 8, wherein said pressurized water source output is controlled by said water level controller.

10. The apparatus of claim 9, wherein said pressurized water source output is also controlled by said booster chamber volume controller.

11. The apparatus of claim 8, wherein said pressurized water source further comprises a water source and a pump.

12. The apparatus of claim 11, wherein said pump is controlled by said water level controller.

13. The apparatus of claim 12, wherein said pump is also controlled by said booster chamber volume controller.

14. The apparatus of claim 11, wherein said pump is controlled by said booster chamber volume controller.

15. The apparatus of claim 8, wherein said booster volume controller includes a selective valve that only allows water into said non-carbonated chamber if the volume of said chamber does not exceed a predetermined level.

16. The apparatus of claim 8, further comprising a supplementary means to prevent said booster chamber from exceeding a predetermined high water volume.

17. The apparatus of claim 16, wherein said supplementary means is a physical restraint.

18. The apparatus of claim 8, further comprising auxiliary means for preventing a low water volume condition in said booster chamber.

19. The apparatus of claim 18, wherein said auxiliary means comprises a switch connected to said pressurized water source, said switch taking priority over said water level controller.

20. The apparatus of claim 8, wherein said pressurized water source output is controlled by said booster chamber volume controller.

21. A combined water carbonator and non-carbonated water pressure booster for use with a carbonating gas source, for supplying both carbonated and non-carbonated water to a beverage dispenser, comprising:

(a) a carbonation chamber including an interior and a carbonated water dispensing outlet, said interior connected to the carbonating gas source;

(b) a booster chamber including an interior and a non-carbonated water dispensing outlet, said booster chamber connected to said carbonation chamber so as to form an area of interface between said chambers, said area of interface being or including a region that is sufficiently flexible or movable to permit the transmission and equilibration of pressure between said interiors of said chambers, and said area of interface being impermeable in the direction going from said carbonated chamber to said non-carbonated chamber;

(c) a pressurized water source including an output connected so as to feed water to said interior of said booster chamber and to said interior of said carbonation chamber; and, (d) a carbonation chamber water level controller coupled to said pressurized water source, wherein said water level controller includes a carbonated water level sensor and a directional chamber selector valve.

22. The apparatus of claim 21, wherein said chamber selector valve is a spool valve.

23. The apparatus of claim 21, wherein said chamber selector valve is a solenoid valve.

24. A combined water carbonator and non-carbonated water pressure booster for use with a carbonating gas source, for supplying both carbonated and non-carbonated water to a beverage dispenser, comprising:

(a) a carbonation chamber including an interior and a carbonated water dispensing outlet, said interior connected to the carbonating gas source;

(b) a booster chamber including an interior and a non-carbonated water dispensing outlet, said booster chamber connected to said carbonation chamber so as to form an area of interface between said chambers, said area of interface being or including a region that is sufficiently flexible or movable to permit the transmission and equilibration of pressure between said interiors of said chambers, and said area of interface being impermeable in the direction going from said carbonated chamber to said non-carbonated chamber;

(c) a pressurized water source including an output connected so as to feed water to said interior of said booster chamber and to said interior of said carbonation chamber; and, (d) a carbonation chamber water level controller coupled to said pressurized water source, wherein said water level controller includes a carbonated water level sensor and a check valve between said interior of said booster chamber and the interior of said carbonation chamber, said check valve oriented so as to only allow flow from the direction of said booster chamber to said carbonation chamber.

25. The apparatus of claim 24, wherein said water level controller further comprises a physical restraint that prevents the expansion of said booster chamber past a predetermined point, after which any water coming into said booster chamber from said pressurized water source incompressibly forces water from said booster chamber into said carbonation chamber via said check valve.

26. The apparatus of claim 25, further comprising a pressure valve and a venturi nozzle attached in line with said check valve, said nozzle being placed on the side of said carbonation chamber.

27. The apparatus of claim 26, further comprising a buffer connected to said non-carbonated water outlet.

28. The apparatus of claim 27, wherein said buffer comprises a small chamber between said non-carbonated water outlet and said beverage dispenser, said buffer chamber adapted to expand by a predetermined amount when subjected to pressure of a predetermined level.

29. The apparatus of claim 24, wherein said check valve does not incur any substantial pressure drop, but said apparatus further comprises a means for improving absorption of carbonating gas placed between the output of said check valve and said interior of said carbonation chamber.

30. A combined carbonator and non-carbonated water pressure booster for use with a water source and a pressurized carbonating gas source, for supplying carbonated and non-carbonated water to a beverage dispenser, comprising:

(a) a tank including a carbonated water chamber and a non-carbonated water chamber, said carbonated water chamber being connected to the pressurized carbonating gas source and having a carbonated water outlet, and said non-carbonated water chamber having a non-carbonated water outlet;

(b) a flexible membrane or movable piston attached to the inside of said tank so as to hermetically separate said carbonated water chamber from said non-carbonated water chamber, said membrane or piston being sufficiently flexible or movable to allow the transmission and equilibration of pressure between said chambers over a range of pressures typically utilized in beverage dispensor carbonation units;

(c) a directional chamber selector valve assembly comprising:

(i) a water inlet;

(ii) a carbonated water chamber outlet connecting said water inlet to said carbonated water chamber;

(iii) a non-carbonated water chamber outlet connecting said water inlet to said non-carbonated water chamber;

(iv) means for obstructing said carbonated water chamber outlet in response to the volume of said non-carbonated water chamber reaching a predetermined lower level, and, alternately, for obstructing said non-carbonated water chamber outlet in response to the volume of said non-carbonated water chamber reaching a predetermined higher level;

(d) a level sensor for detecting a predetermined low water level condition in said carbonated water chamber and producing a first signal in response thereto, and for detecting a predetermined high water level condition in said carbonated water chamber and producing a second signal in response thereto;

(e) a water pump connected to the water source and to said water inlet, and adapted to respond to said first signal by pumping water from the water source into said water inlet, and adapted to respond to said second signal by ceasing pumping water to said water inlet.

31. A retrofittable non-carbonated water pressure booster for use with a water source, a pressurized carbonating gas source, and an existing carbonation unit, for supplying a beverage dispenser, in the form of an add-on unit comprising:

(a) a non-carbonated water booster chamber having an interior and a non-carbonated water outlet;

(b) an interface connected to said interior of said booster chamber, said interface adapted to connect to the interior of the existing carbonation unit, and said interface sufficiently movable or flexible to allow the equilibration of pressure between the interior of the carbonation unit and said interior of said booster chamber;

(c) an inlet provided into said interior of said booster chamber and adapted to connect to a pressurized water source.

32. The apparatus of claim 31, wherein said interface is connected to the headspace of the existing carbonation unit, but does not contact the carbonated water contained in the carbonation unit.

33. The apparatus of claim 31, wherein said interface is a flexible membrane.

34. The apparatus of claim 31, wherein said interface is a movable piston.

35. The apparatus of claim 31, wherein said pressurized water source is a part of the existing carbonation unit.

36. A combined water carbonator and non-carbonated water pressure booster tank, comprising:

a port defined in the tank, a flexible membrane located within the tank and fixed relative to the tank so as to hermetically separate the tank into a carbonated chamber and a non-carbonated chamber, said carbonated chamber being remote from said port, and said non-carbonated chamber being proximate to said port, a carbonating gas source inlet connected to said carbonated chamber, a carbonated water dispensing outlet connected to said carbonated chamber, a non-carbonated water dispensing outlet connected to said non-carbonated chamber, and a valve assembly fixed to said port such that said port is closed, said valve assembly comprising:

a valve body, an elongate probe slidably mounted to said valve body and extending into said non-carbonated chamber, a valve element located in said valve body and connected to and controlled by said probe, a plain water source inlet connected to said valve element, a first plain water outlet connected to said valve element and to said non-carbonated chamber, a second plain water outlet connected to said valve element and to said carbonated chamber, wherein said valve element is adapted to selectively control flow through said first and second plain water outlets.

37. The apparatus of claim 36, further comprising a carbonated water level sensor coupled to a plain water source inlet controller, said plain water source inlet being connected to and controlled by said controller.

38. The apparatus of claim 37, wherein said controller includes a pump.

39. The apparatus of claim 36, wherein said non-carbonated water dispensing outlet is defined through said valve assembly.

40. The apparatus of claim 36, wherein said probe is spring biased toward said membrane.

41. The apparatus of claim 36, wherein said membrane includes a connecting means that is connected to the remote end of said probe.

42. The apparatus of claim 36, wherein said valve element is a valve spool.

43. The apparatus of claim 36, wherein said flexible membrane is a bladder, the interior of which constitutes said non-carbonated chamber.

44. The apparatus of claim 43, wherein said bladder includes an open socket that is connected to said valve assembly at said port.

45. The apparatus of claim 44, wherein said valve assembly is removably connected to said port, such that said valve assembly and bladder can be removed from the tank.

* * * * *